United States Patent [19]

Borstcher

[11] Patent Number: 4,891,850

[45] Date of Patent: Jan. 9, 1990

[54] ARTICULATED SHOWER-BATH SCREEN SHUTTERS FOR A BATH-TUB, A SHOWER RECEIVER AND LIKE TUB

[76] Inventor: Georges Borstcher, Résidence "Le Trianon", 52 rue des Eveuses, 78120 Rambouillet, France

[21] Appl. No.: 143,221

[22] Filed: Jan. 4, 1988

Related U.S. Application Data

[63] Continuation of Ser. No. 910,525, Sep. 22, 1986, abandoned.

[30] Foreign Application Priority Data

Sep. 25, 1985 [FR] France ..... 85 14197

[51] Int. Cl.[4] ..... A47K 3/22

[52] U.S. Cl. ..... 4/609; 4/610

[58] Field of Search ..... 4/609, 557, 607, 610; 49/255, 36

[56] References Cited

U.S. PATENT DOCUMENTS

| | | | |
|---|---|---|---|
| 742,763 | 10/1903 | Ware | 49/255 |
| 1,604,810 | 10/1926 | Crist | 4/557 |
| 3,346,992 | 10/1967 | Lodge | 49/255 |
| 3,864,875 | 2/1975 | Hewitt | 49/360 |
| 3,955,239 | 5/1976 | Grossman | 4/607 |

FOREIGN PATENT DOCUMENTS

| | | | |
|---|---|---|---|
| 2575650 | 7/1986 | France | 4/559 |

*Primary Examiner*—Linda J. Sholl

*Attorney, Agent, or Firm*—Browdy and Neimark

[57] ABSTRACT

An articulated shower-bath screen shutter for a bath-tub, shower receiver and like tub comprises a vertically sliding profile for supporting a spindle on which is articulated at least one shutter having a given weight. The sliding profile is guided by a guiding profile (7) to which it is connected by balancing device (19) for balancing the given weight of the at least one shutter supported by the spindle.

7 Claims, 3 Drawing Sheets

1
2
3
3a
4
5
II

3
III
4
4a
5
6
7
8
9
10
12
13
14
15
16
17
19
21
22
23
24
25

ARTICULATED SHOWER-BATH SCREEN SHUTTERS FOR A BATH-TUB, A SHOWER RECEIVER AND LIKE TUB

This application is a continuation, of application Ser. No. 910,525, filed Sept. 22, 1986, now abandoned.

BACKGROUND OF THE INVENTION

The present invention relates to the type of articulated shower-bath screen shutters which are used above bath-tubs, shower receivers and like tubs and which can, in their rest position, be brought against one of the walls to which the bath-tub, shower receiver and like tub is mounted.

The invention relates still more particularly to those shower-bath screen shutters which are at the same time articulated and mounted for sliding vertically so that, for example, they can be brought above a tap assembly, above a soap-dish or above another article which may be in the vicinity of one of the edges of the bath tub, shower receiver and like tub, e.g. as shown in French patents 2,530,339 and 2,575,650.

SUMMARY OF THE INVENTION

According to the invention, the articulated shower-bath screen shutter for a bath-tub, a shower receiver and like tub in which is provided a vertically sliding profile for supporting a spindle on which is articulated at least one shutter having a given weight, is characterized in that the sliding profile is guided by a guiding profile to which it is connected by a balancing or shutter weight compennsating means for counter-balancing the weight of the at least one shutter supported by the spindle.

Various other features of the invention will become more apparent from the following detailed description.

BRIEF DESCRIPTION OF THE DRAWINGS

An embodiment of the invention is shown by way of a non limiting example in the accompanying drawings, wherein.

DESCRIPTION OF A PREFERRED EMBODIMENT

Figure 1:
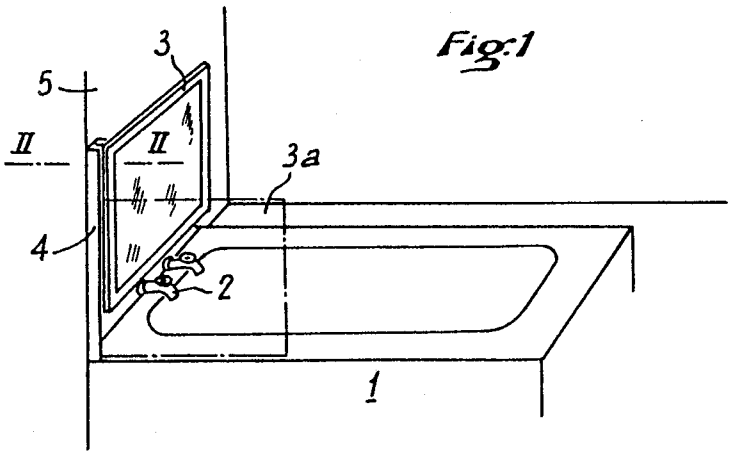
FIG. 1 is a schematic perspective view of an articulated shower-bath screen implementing the invention.

FIG. 1 shows schematically a bath-tub 1 provided above one of its smaller sides with a tap assembly 2, and at least one shower-bath screen shutter 3 which is connected to a support profile 4 fixed to a wall 5. The support profile 4 includes a mechanism which is hereafter described and which enables pivoting of the shower-bath screen shutter 3 from a position in which it is shown in full lines against the wall 5 and above the tap assembly 2 to a position 3*a* in which the shutter 3 shown in phantom lines is lowered so as to rest on the longitudinal side of the bath-tub 1 and thereby preventing water from splashing out of the bath tub.

Figure 2:
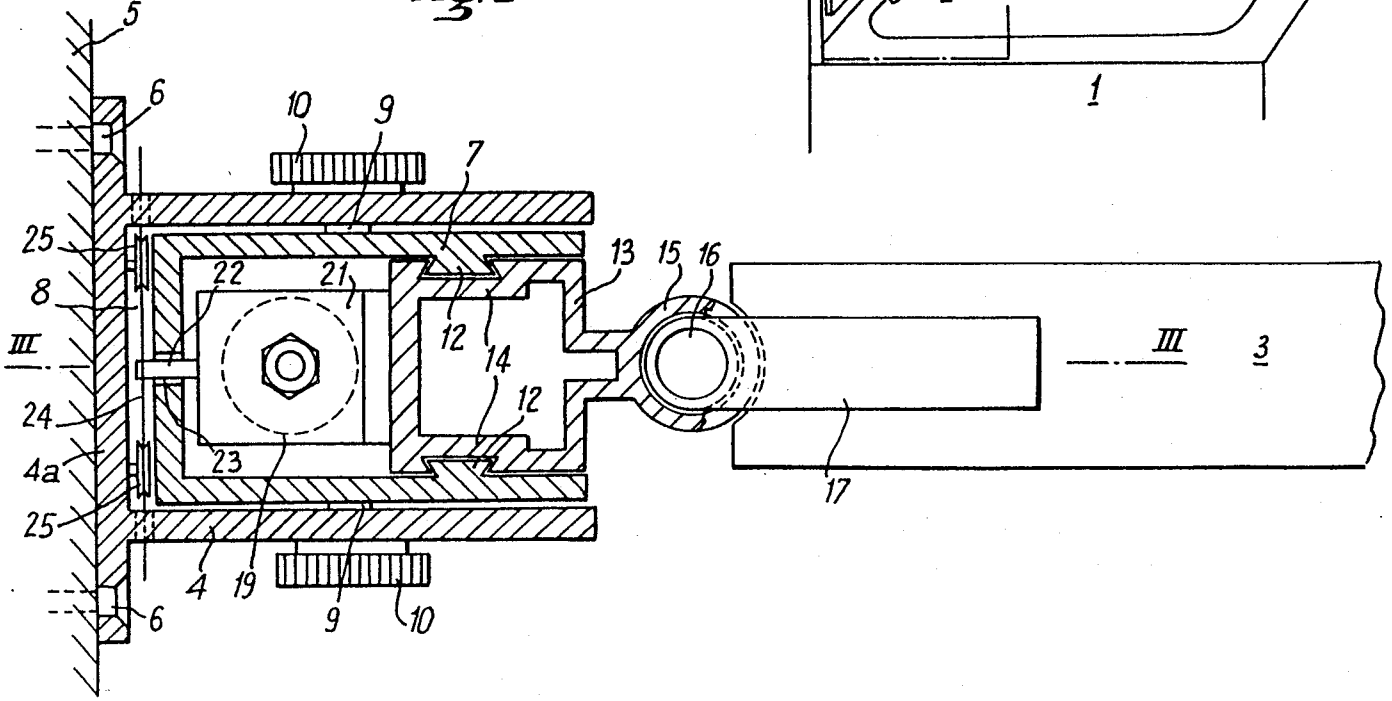
FIG. 2 is an enlarged sectional view of FIG. 1 taken substantially along line II—II of FIG. 1.

FIG. 2 shows that the support profile 4 is provided with a sole-piece 4*a* attached to the wall 5 by screws 6. Lateral sides of the support profile 4, which are perpendicular to the sole-piece 4*a*, define with the sole-piece 4*a* a kind of stirrup.

The support profile 4 comprises a guiding profile 7 which is engaged with a slip fit between the lateral sides of the profile 4. Depth of the guiding profile 7 is smaller than that of the profile 4 in order to define a space 8 between the bottom of the guiding profile 7 and the sole-piece 4*a*.

As shown in the drawings, it is advantageous that screws 9, for example carried by knurled knobs 10, are screwed in the lateral sides of the guiding profile 7 by extending through buttonhole-shaped slots 11 (FIG. 3) formed in the support profile 4. In this manner, it is possible to correct or compensate for possible verticality defects of the supporting wall 5, i.e. to make the profile 7 vertical even though the supporting wall 5 is not vertical. Thus, by means of the knurled knobs 10, it is possible to adjust the position of the screws 9 within the slots 11 and thereby adjust the guiding profile 7 with respect to the support profile 4 so that the guiding profile 7 will be made vertical even if the wall 5 maintaining the support profile is not strictly vertical.

The guiding profile 7 comprises guiding elements 12, for example dovetaile-shaped ribs, used for vertically guiding a sliding profile 13. The sliding profile 13 comprises guiding elements 14 which are complementary to the guiding elements 12, for example dovetail-shaped ribs.

The sliding profile 13 protrudes beyond the lateral sides of the guiding profile 7 and of the support profile 4, and the sliding profile 13 forms a sheath 15 for housing a spindle 16 on which are fixed platens 17 adapted for supporting the shutter 3 and possibly other shutters connected in a sliding or articulated manner to the shutter 3.

Figure 3:
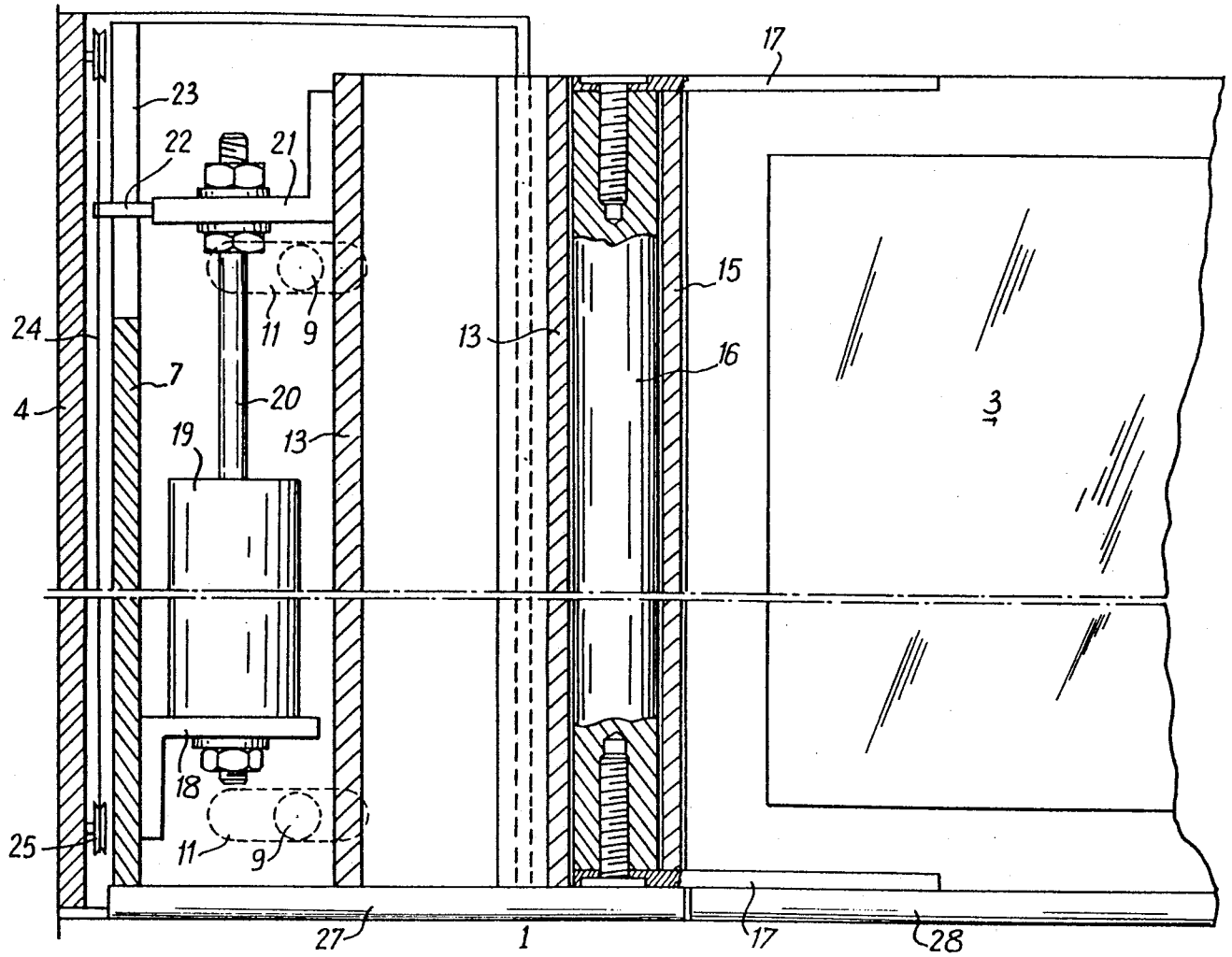
FIG. 3 is a sectional view of FIG. 2 taken substantially along line III—III of FIG. 2.

As shown in FIG. 3, the guiding profile 7 insidely supports, for example through its bottom, a bracket 18 on which is mounted a gas actuator 19 sometimes called a gas spring, having a piston stem 20 which is connected to a bracket 21 attached to the sliding profile 13. The gas actuator 19 is provided for maintaining the sliding profile 13 in a raised position, that is for maintaining the shutter 3 in the position shown in full lines in FIG. 1. However, the strength of the gas actuator 19 is advantageously calculated so that the shutter is practically in a position of equilibrium, i.e. it is balanced during movement, and only a very small force is necessary for bringing it down to the position 3*a*, of FIG. 1 position in which it can be thereafter maintained by any suitable latching or fixing means of the type typically shown by the tightening knob 13 of the above French reference 2,575,650.

Figure 4:
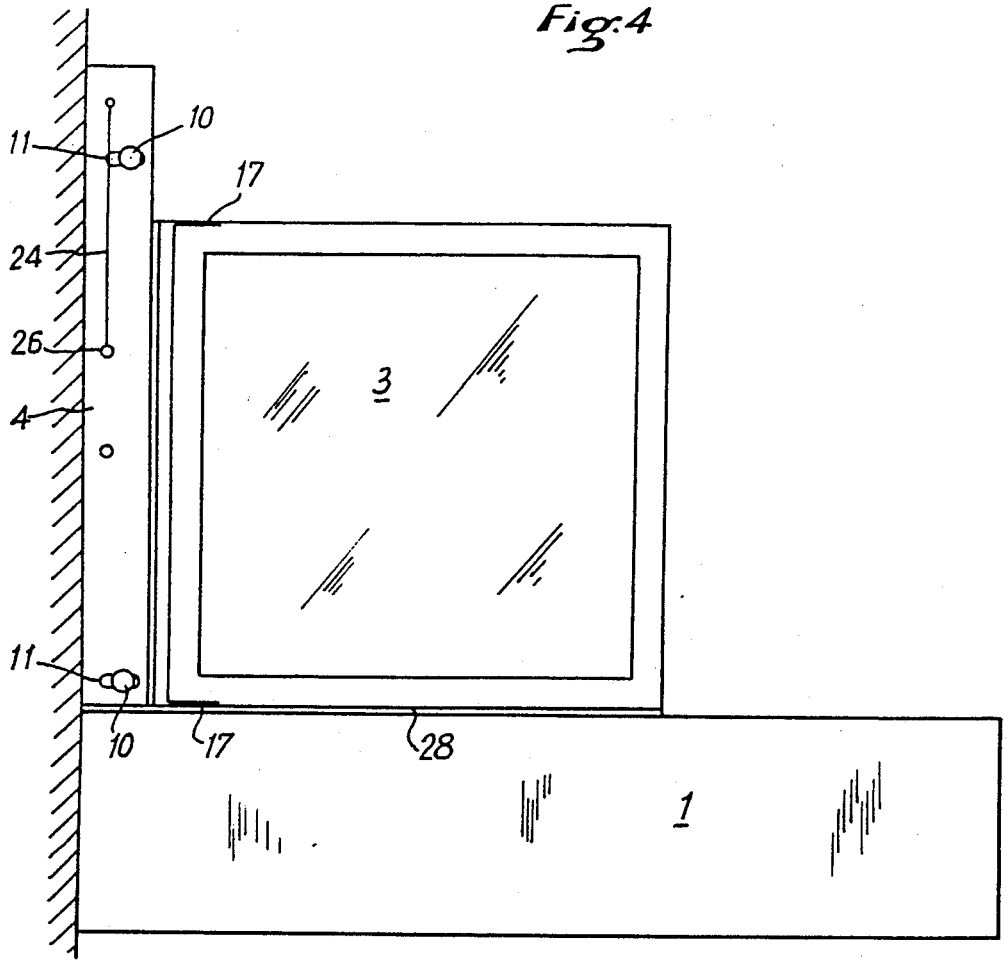
FIG. 4 is a side elevation view corresponding to FIG. 1 and illustrating a particular feature.

A particular lacthing or fixing means is shown in the drawing for facilitating a descent and maintenance in a low position of the sliding profile 13, it is further advantageous to provide the bracket 21 with a finger 22 extending through a slot 23 of the guiding profile 7. The finger 22 is connected to one or a plurality of pull cords 24 passing on one or a plurality of pulleys 25 mounted in the space 8 on the bottom 4*a* of the support profile 4. FIG. 4 shows that the pull cords 24 can be fixed, for example, on studs 26.

In addition to the preceding disclosure, it is advantageous as shown in FIG. 3 to provide the base of the support profile 4 with a watertightness seal 27 and to provide also the base of the shutter 3 with a watertightness pad 28, the seal 27 and pad 28 thus resting on the longitudinal edge of the bath-tub 1.

The invention is not limited to the embodiment shown and described in detail, and various modifications can be imparted to it without departing from the scope of the invention as shown in the appendant claims. In particular, according to a simplified embodiment, the support profile 4 can be omitted and, in such a case, the guiding profile 7 is directly attached to the wall 5, for example by means of screws extending through its bottom; samely, a counterweight can be interposed between the two brackets 18 and 21 with the bracket 18 being attached to the guiding profile 7 and the bracket 21 being attached to the sliding profile 13.

What is claimed is:

1. A pivotally mounted shower shield for a bath tub, shower receiver and like tub, comprising at least on shutter; articulating means for articulating said at least one shutter between two positions at right angle of said bath tub, shower receiver and like tub; guiding means provided on said articulated means for vertically guiding said at least one shutter between an up position and a down position; and shutter weight compensating means for counterbalancing said at least one shutter during movement and in any position between said up position and said down position, and wherein the guiding means comprises a guiding profile and a sliding profile with said guiding profile being disposed inside a support profile, and wherein a finger is fixed to said sliding profile and extends through a slot of the guiding profile, said finger being connected to at least one pull cord adapted to be fixed to studs provided on the support profile.

2. The shield of claim 1, wherein the compensating means comprises a resilient element.

3. The shield of claim 1, wherein the guiding means comprises a guiding profile provided with a first bracket and a sliding profile with a second bracket, the compensating means comprising a counterweight interposed between said first and second brackets.

4. The shield of claim 1, wherein the compensating means comprises a gas actuator.

5. The shield of claim 1, wherein the guiding means comprises a guiding profile disposed inside a support profile fixed to a vertical wall, the guiding profile being provided with a screw and the support profile being provided with a slot, said screw extending through said slot for a vertical adjustment of the guiding profile with respect to said vertical wall.

6. The shield of claim 1, wherein the guiding means comprises a guiding profile with latching means connected to said sliding profile for maintaining said at least one shutter in a low position in which said at least one shutter is resting on an edge of the bath-tub, shower receiver and like tub.

7. The shield of claim 1, wherein the guiding means comprises a support profile with watertightness seals and pad being fixed to a base of said support profile and of said at least one shutter.

* * * * *